US007322620B1

(12) United States Patent
Lawrence

(10) Patent No.: US 7,322,620 B1
(45) Date of Patent: Jan. 29, 2008

(54) SECURITY LOCK FOR A SASH TYPE WINDOW

(76) Inventor: Barry G. Lawrence, 1515 Johnsontown Rd., Thomasville, NC (US) 27360

( * ) Notice: Subject to any disclaimer, the term of this patent is extended or adjusted under 35 U.S.C. 154(b) by 45 days.

(21) Appl. No.: 11/136,066

(22) Filed: May 24, 2005

(51) Int. Cl.
*E05C 3/14* (2006.01)
*E05F 1/00* (2006.01)

(52) U.S. Cl. ..... 292/242; 292/240; 292/DIG. 20; 292/DIG. 47; 49/449

(58) Field of Classification Search ..... 292/65, 292/240–241, DIG. 20, DIG. 47, 242; 70/89, 70/90; 49/449
See application file for complete search history.

(56) References Cited

U.S. PATENT DOCUMENTS

| | | | | | |
|---|---|---|---|---|---|
| 192,614 | A * | 7/1877 | Andrews | 292/52 |
| 253,534 | A * | 2/1882 | Howard | 70/90 |
| 314,350 | A * | 3/1885 | Smith | 292/65 |
| 369,885 | A * | 9/1887 | Shaw | 292/65 |
| 375,656 | A * | 12/1887 | Shaw | 292/65 |
| 520,754 | A * | 5/1894 | Burmeister | 292/65 |
| 528,656 | A * | 11/1894 | Burmeister | 292/65 |
| 539,030 | A * | 5/1895 | Bitner | 292/111 |
| 2,997,323 | A * | 8/1961 | Riser | 292/111 |
| 4,261,602 | A * | 4/1981 | Anderson | 292/143 |
| 5,161,839 | A * | 11/1992 | Piltingsrud et al. | 292/241 |
| 5,219,193 | A * | 6/1993 | Piltingsrud | 292/240 |
| 5,452,925 | A * | 9/1995 | Huang | 292/57 |
| 5,741,032 | A * | 4/1998 | Chaput | 292/202 |
| 6,068,306 | A | 5/2000 | Brautigam | 292/242 |
| 6,142,541 | A | 11/2000 | Rotondi | 292/241 |
| 6,568,723 | B2 | 5/2003 | Murphy et al. | 292/241 |
| 6,601,270 | B2 * | 8/2003 | Eckhardt et al. | 16/412 |
| 6,871,886 | B2 | 3/2005 | Coleman et al. | 292/241 |
| 7,000,957 | B2 | 2/2006 | Lawrence | 292/241 |
| 7,063,361 | B1 | 6/2006 | Lawrence | 292/241 |
| 2004/0262929 | A1 * | 12/2004 | Trickel | 292/241 |
| 2006/0087130 | A1 * | 4/2006 | Liang | 292/242 |

* cited by examiner

*Primary Examiner*—Carlos Lugo
(74) *Attorney, Agent, or Firm*—Birch, Stewart, Kolasch & Birch, LLP

(57) ABSTRACT

A security lock for sash windows includes an elongated cam that revolves in order to engage a keeper. The security lock also includes a tab that urges the cam against a wall of a housing to provide extra security. Once the cam contacts the housing wall it will not rotate to open as occurs in conventional sash locks. A groove and a race within the top inside of the housing direct a guide affixed to the top of the cam a), initially in a circular direction, and b), finally into a lateral direction into engagement with a locking stud on the wall of the housing. A rotating tab affixed to the handle axle causes the final cam movement during the locking process.

20 Claims, 4 Drawing Sheets

SECURITY LOCK FOR A SASH TYPE WINDOW

FIELD OF THE INVENTION

The invention herein pertains to window locks and the like and particularly pertains to a sash type window lock having a slideable cam for engaging a keeper.

DESCRIPTION OF THE PRIOR ART AND OBJECTIVES OF THE INVENTION

In recent years burglars have become adapt at opening sash type windows from the outside of a house or other building by first removing the window screen and placing a putty knife or similar thin bladed instrument between the sashes to rotate the cam to an unlocked posture. The blade is used by unauthorized persons to urge the rotatable cam to disengage the cam from the keeper. Once the cam has been disengaged the sash is then openable for entry purposes. Attempts have been made to secure such windows such as by use of extra locks or by drilling holes in the sash and window frame and inserting nails or steel rods therein for immobilization. However adding locking devices tends to inconvenience the home or business owner and obstructs the intended function of the window. Certain sash window locks have been designed in the past to prevent unauthorized entry such as shown in U.S. Pat. No. 6,142,541.

Window reinforcements, locks and other means to prevent entry are often expensive, inconvenient and are often difficult to use and require extra thought, time and effort by the owner. Sometimes the additions are forgotten and when forgotten, the original locks provide little if any protection against unauthorized entry.

Based on the problems and disadvantages associated with conventional sash type window locks and locking systems, the present invention was conceived and one of its objectives is to provide a sash type window lock which can be mounted on the top rail of the sash for engagement with a keeper mounted on an opposing bottom sash rail when the window is closed.

It is another objective of the present invention to provide a sash type window lock which is handle-operated as a conventional lock yet which provides added security.

It is still another objective of the present invention to provide a sash type window lock which includes a tab contained within a rotatable cam which urges or slides the cam in a lateral direction to engage the cam against a locking stud on the cam housing.

It is yet another objective of the present invention to provide a sash type window lock having a groove in the housing for containing a cam guide to direct the cam in its final locking movement in a short lateral direction.

Various other objectives and advantages of the present invention will become apparent to those skilled in the art as a more detailed description is set forth below.

SUMMARY OF THE INVENTION

The aforesaid and other objectives are realized by providing a lock formed from a plastic composite material, or a metal such as zinc, aluminum or other suitable materials. The preferred form of the lock includes a handle, housing, cam and keeper formed form a standard zinc die-cast material having added security for use on sash type windows and the like. The lock includes a housing with an indent which contains an elongated, rotatable slideable cam. Along the inside top of the indent is a question mark-like ("?") groove which allows a guide affixed to the cam to direct the cam in a generally circular direction and lastly to guide the cam in a short, lateral direction to lock the cam against the housing wall. The elongated cam allows the keeper catch to be engaged while allowing the sashes to move laterally to each other. This will accommodate for a slightly misaligned keeper. A handle is joined to an axle which passes through the top of the housing as conventional. The elongated cam is positioned on the axle and includes an elongated axle port and defines a tab well having dual lobes. The axle will rotate the cam and tab and will slide the cam. As the cam rotates, the terminal end of the housing groove prevents further circular rotation. As conventional, rotation of the cam causes the cam channel to engulf a keeper catch positioned on an opposing window frame or sash. Once the cam's circular rotation stops, additional turning of the handle in the same direction causes the tab to turn a few degrees which forces the cam to move laterally and into engagement with a locking stud on the interior indent wall. A locking notch on the cam receives the locking stud for security.

With the cam engaging the locking stud, pressure along the outer surface of the cam such as with a knife or other blade by an unauthorized person will not rotate the cam. Thus the window cannot be unlocked by such contact as in conventional sash locks. As would be understood, rotation of the cam during locking causes the sweep arm channel to engulf the keeper catch positioned on an opposing window frame or sash as typical.

To unlock the window the handle is merely turned in an opposite direction which disengages the cam from the locking stud and upon further rotation first disengages the cam notch from the locking stud, then the sweep arm channel from the keeper catch so the window can be opened or moved relative to the opposing window sash or frame.

DETAILED DESCRIPTION OF THE PREFERRED EMBODIMENT AND OPERATION OF THE INVENTION

Figure 3:
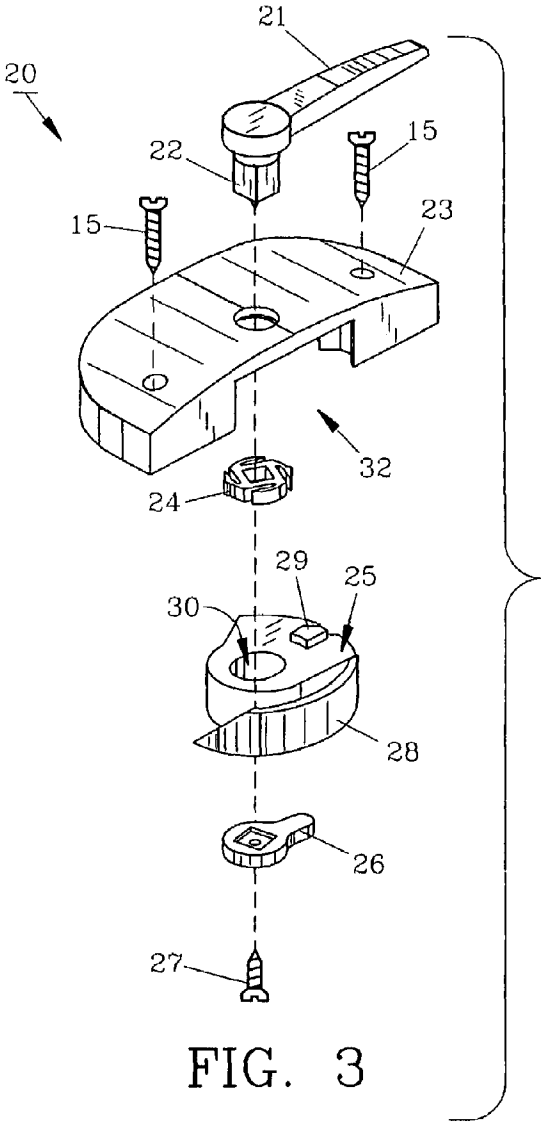
FIG. 3 demonstrates an exploded perspective of the window lock as seen in FIG. 2.
Figure 1:
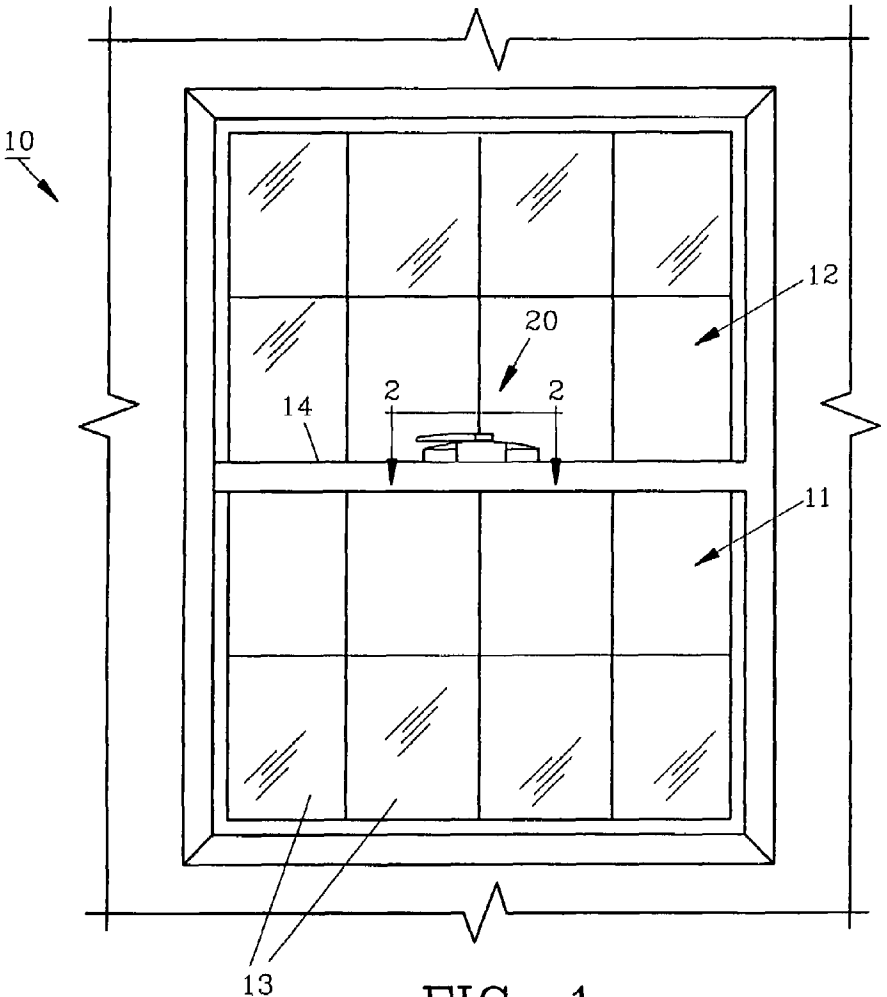
FIG. 1 demonstrates a typical sash type window with the window lock of the invention as seen from inside a building.
Figure 2:
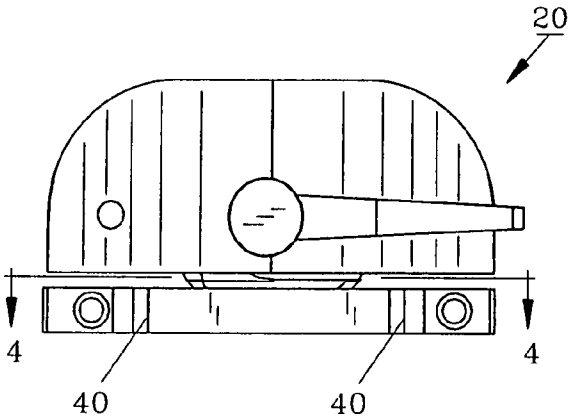
FIG. 2 shows a top plan view of the window lock and keeper as shown along line 2-2 of FIG. 1.
Figure 4:
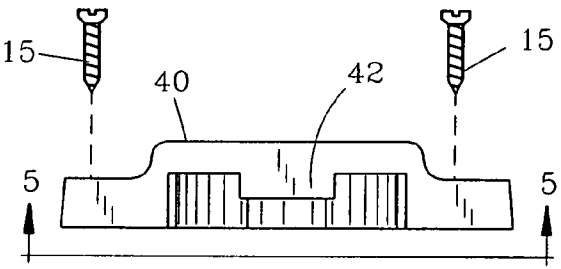
FIG. 4 depicts an elevational view of the keeper as shown in FIG. 2 along line 4-4.
Figure 5:
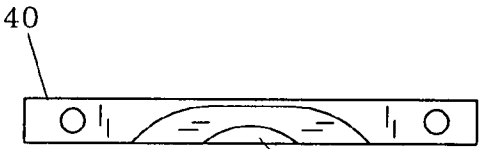
FIG. 5 illustrates a bottom view of the keeper as shown along line 5-5 in FIG. 4.
Figure 8:
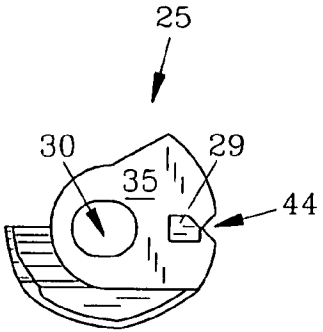
FIG. 8 pictures a top view of the cam as shown in FIG. 7.
Figure 9:
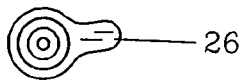
FIG. 9 demonstrates a bottom view of the tab as shown in FIG. 3.
Figure 7:
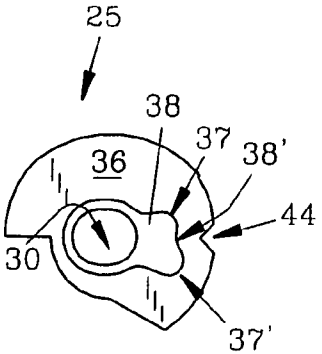
FIG. 7 illustrates a bottom view of the cam as removed from the housing.

For a better understanding of the invention and its operation, turning now to the drawings, FIG. 1 illustrates in schematic fashion typical sash window 10 as used in homes and other buildings. Window 10 includes lower movable sash 11 having eight (8) glass panes 13 and top rail 14. Upper sash 12 may be movable or fixed and includes a bottom rail (not shown) which is coplanar with top rail 14 of sash 11 when window 10 is fully closed as seen in FIG. 1. Preferred sash lock 20 formed from a standard zinc die-cast material is shown mounted to top rail 14 of sash 11 and as would be understood, a keeper such as conventional keeper 40 is mounted to the bottom rail (not shown) of upper sash 12 and is aligned for engagement with lock 20. Lock 20 may also be formed from a standard nylon/fiberglass composite material if desired. Lock 20 and keeper 40 are affixed to window 10 as by conventional screws 15 seen in FIG. 4, although other suitable attachment means may be utilized. Keeper 40 is also shown in FIGS. 2, 4 and 5 removed from the bottom rail (not shown) of upper sash 12. Preferred sash lock 20 is seen exploded in FIG. 3 for clarity purposes. Sash lock 20 includes handle 21 which is joined to rectangularly shaped axle 22. Axle 22 passes through housing 23, tension member 24 and cam 25 where it engages tab 26 (FIG. 9). Threaded member 27 is tightened through apertures (not shown) into tab 26 and axle 22 to maintain structural integrity during use. As is standard in the trade, locking and unlocking of window sash 11 is done so manually by rotating handle 21. Rotation of handle 21 causes cam 25 and tab 26 to likewise rotate. As further seen in FIGS. 3 and 8, cam 25 includes elongated sweep arm 28 and guide 29 on top 35. As also seen in FIGS. 3, 7 and 8 cam 25 includes elongated axle port 30 which extends therethrough from top 35 to bottom 36. Bottom 36 defines well 38 which is in communication with axle port 30, and includes first and second lobes 37, 37' having well wall 38' therearound. Axle port 30 permits cam 25 to rotate a short distance laterally along housing 23 and axle 22.

Figure 6:
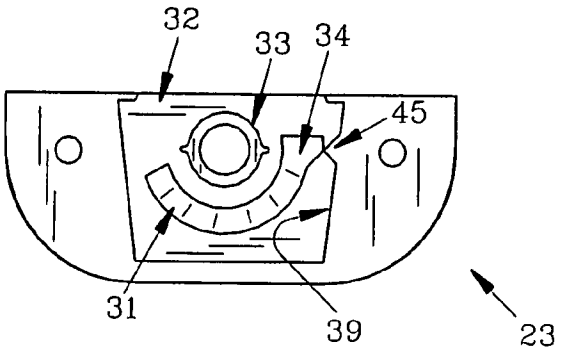
FIG. 6 shows a bottom plan view of the window lock housing as seen in FIG. 3 but with the handle, cam, spring, tab and fastener removed.

Housing 23 as seen in FIG. 6 includes indent 32, race 31 and groove 33. Groove 33 maintains resilient tension member 24 therein while cam 25 is maintained within indent 32 whereby cam guide 29 is rotatably and slideably contained within race 31. Race 31 is substantially shaped like a question mark "?" having terminal end 34 which allows guide 29 to move laterally, that is from left to right as shown in FIG. 6. Thus cam 25 rotates in a counterclockwise direction (see FIG. 6) and terminates when cam guide 29 reaches terminal end 34 whereby locking stud notch 44 of cam 25 engages locking stud 45 of housing 23. Upon further rotation of handle 21, cam guide 29 causes cam 25 to move to the right (laterally) along terminal end 34 to contact locking stud notch 44 with locking stud 45 (FIGS. 7 and 8) while simultaneously tab 26 is rotated and urged from lobe 37' to engage smaller lobe 37.

Figure 10:
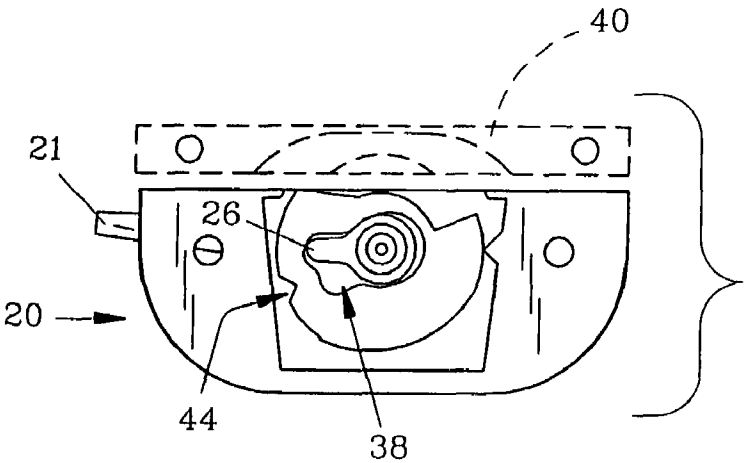
FIG. 10 depicts a bottom view of the window lock as seen in FIG. 2 with the keeper shown in ghost fashion and in an opened or unlocked posture.

The preferred method of locking window sash lock 20 is seen in various steps in FIGS. 10-14 with lock 20 and keeper 40 each shown in a bottom plan view. In FIG. 10, keeper 40 is slightly spaced from lock 20 with cam 25 seen in an open, unlocked posture as with window 10 closed. Tab 26 maintained within well 38 is positioned in lobe 37'. Well 38 is sized to allow tab 26 to slide and rotate therewithin.

Figure 11:
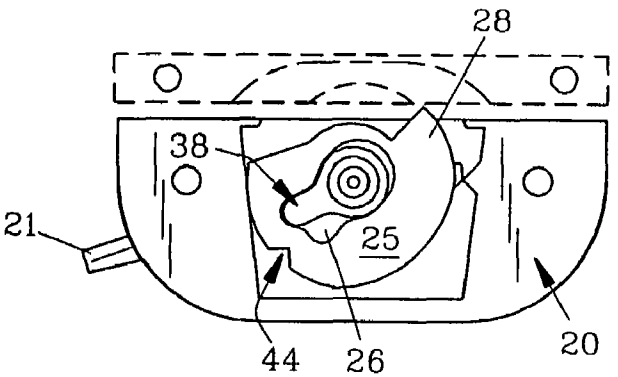
FIG. 11 shows the handle being turned clockwise approximately forty-five to fifty degrees (45-50°) to begin the locking cycle with the keeper.

In FIG. 11, handle 21 has been moved in a counterclockwise direction about forty-five to fifty degrees (45-50°) from that seen in FIG. 10 to rotate cam 25 and tab 26 which rests in lobe 37' of well 38.

Figure 12:
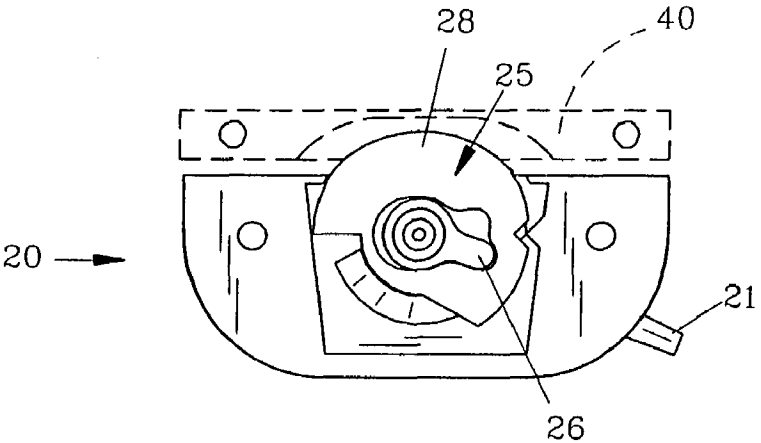
FIG. 12 illustrates a further progression of the locking cycle with the handle turned clockwise approximately one hundred sixty-five degrees (165°) from that shown in FIG. 10.

Upon further counterclockwise rotation as shown in FIG. 12, cam sweep arm 28 fully engages keeper catch 42 as seen in FIG. 5 to lock window sash 11 and further rotation of cam 25 is terminated by cam guide 29 in terminal end 34 of race 31. This is a typical sash lock cam movement. Tab 26 is still maintained within lobe 37'.

Figure 14:
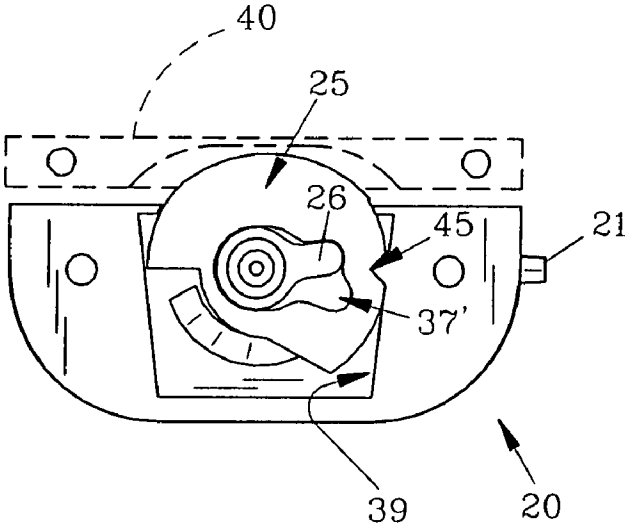
FIG. 14 features the handle turned approximately one hundred eighty-five degrees (185°) from that shown in FIG. 10 into its fully locked position with the tab contained within the second lobe of the cam well.
Figure 13:
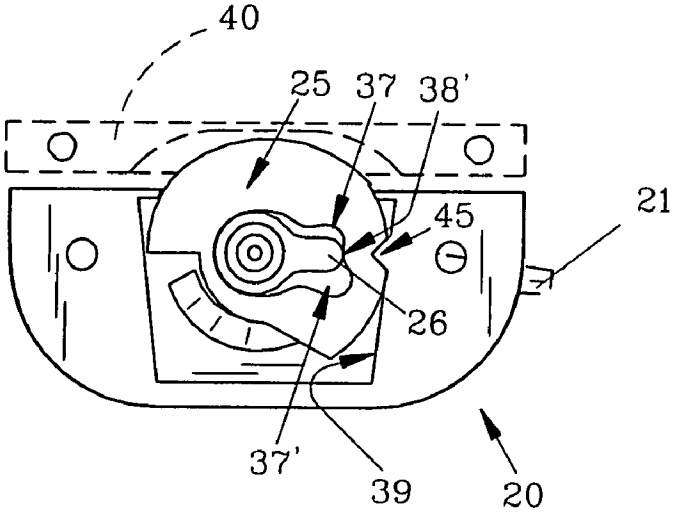
FIG. 13 demonstrates the handle turned clockwise approximately one hundred eighty degrees (180°) with the tab seen forcing the cam against the locking stud.

Now, additional security is provided and upon further counterclockwise rotation of handle 21 as shown in FIG. 13, tab 26 is urged to continue its counterclockwise rotation a few degrees thereby causing cam 25 to move laterally, in a left to right direction as shown in FIG. 13 as tab 26 is rotated from lobe 37' thus contacting well wall 38' causing cam locking stud notch 44 (see FIGS. 10 and 11) to engage V-shaped locking stud 45 on indent wall 39 before continuing, to rest in lobe 37 as shown in FIGS. 13 and 14. Elongated axle port 30 in cam 25 permits cam 25 to slide laterally, that is from left to right as shown in FIGS. 13 and 14 into engagement with locking stud 45. Locking stud 45 engages notch 44 of cam 25 and any pressure such as from a thin blade bearing on cam 25 to attempt unauthorized rotation of cam 25 in a clockwise direction for unlocking purposes, merely forces locking stud 45 into tighter engagement with notch 44. Thus additional security to window lock 20 arises with slideable cam 25, tab 26, notch 44 and locking stud 45. Lock 20 can then be opened in an authorized manner by turning handle 21 in the opposite direction to rotate and disengage tab 26 from lobe 37 and into lobe 37' whereby sweep arm 28 is rotated from keeper catch 42 which thus allows sash 11 as seen in FIG. 1 to slide open as desired.

Handle 21, housing 23 and keeper 40 can be manufactured from a variety of conventional materials, designer colors and coatings. A soft or resilient polymeric foam or other coating can be applied as an overmolding to the structural material of handle 21, housing 23 and keeper 40 for safety purposes such as to protect a child that strikes the components in an accidental fall.

The illustrations and examples provided herein are for explanatory purposes and are not intended to limit the scope of the appended claims.

I claim:

1. A lock comprising:

a housing, said housing including an indent, a race, and a locking stud extending inward from a side wall of the indent adjacent to a terminal end of the race, a cam, said cam positioned within said indent, said cam defining a well, a rotatable tab, an axle, said tab mounted on said axle within said well, whereby upon rotation of said axle, said tab revolves to urge said cam into a locked posture against said housing, and wherein said tab is pivotable by more than 180° from an unlocked position to a locked position within said well.

2. The lock of claim 1 wherein said locking stud is V-shaped.

3. The lock of claim 1 further comprising a handle, said handle affixed to said axle.

4. The lock of claim 1 wherein said locking cam defines an axle port, said axle port for receiving said axle.

5. The lock of claim 4 wherein said axle port is elongated, said cam slideable on said axle along said axle port.

6. The lock of claim 4, wherein the cam and the axle port are elongated along the same axis.

7. The lock of claim 1 wherein said tab is pivotably mounted within said well, the well being formed on a bottom side of the cam.

8. The lock of claim 1 wherein said cam includes a locking stud notch formed on a curved outer edge thereof, said locking stud notch for selectively receiving said locking stud.

9. The lock of claim 1 wherein said housing defines a groove.

10. The lock of claim 1 wherein said cam is elongated and includes a guide affixed to said cam, said guide being positioned in said race of said housing.

11. The lock of claim 1 further comprising a keeper, said cam engaging said keeper.

12. The lock of claim 1 wherein the well of the cam is entirely surrounded by a wall, the cam including a first rounded lobe and a second rounded lobe formed in the wall, the first rounded lobe being larger than the second lobe.

13. The lock of claim 1, wherein the lock is a window sash lock.

14. A lock for a window sash comprising:

a housing, said housing defining an indent, a rotatable and slideable cam, said cam including a well entirely surrounded by a wall formed on a bottom side of the cam, and an elongated axle port extending from a top side to the bottom side of the cam, an axle, said axle positioned within said axle port to allow said cam to selectively rotate and slide within said indent, said cam includes a first rounded lobe and a second rounded lobe formed in said wall that receives a rotatable tab therein, said tab is mounted to said axle, whereby upon rotation of said axle, said tab revolves to urge said cam into a locked posture against said housing.

15. The lock of claim 14 further including a V-shaped locking stud extending inward from a side wall of the indent of the housing, said cam including a locking stud notch formed on a curved outer edge thereof, wherein said cam is adapted to be rotated and slid so said V-shaped locking stud engages said cam notch.

16. The lock of claim 14 further comprising a handle, said handle attached to said axle for turning said cam.

17. The lock of claim 14 wherein said cam is elongated.

18. In a locking system for a sash type window in which a keeper mounted on a window frame is engageable with a lock mounted on a window sash to selectively immobilize sash movement, the improvement comprising:

a lock, said lock comprising a housing, said housing defining an indent, a cam, said cam positioned in said indent for rotation into engagement with said keeper, said cam defining an elongated axle port, an axle, said axle contained within said axle port, said cam further defining a well, a tab, said tab attached to said axle and contained within said well, said tab for urging said cam along said axle port into contact with said housing and into engagement with said keeper to prevent sash movement, wherein rotation of the tab urges a locking stud of the housing into a locking stud notch formed on a curved outer edge of the cam.

19. The locking system of claim 18 wherein said housing includes a race, a V-shaped locking stud extending inward from a side wall of the indent of the housing, and wherein said cam includes a guide positioned in said race of the housing, whereby upon rotation of said cam said guide directs said cam against said locking stud.

20. The locking system of claim 18 wherein the well of the cam is entirely surrounded by a wall, the cam including a first rounded lobe and a second rounded lobe formed in the wall, the first rounded lobe being larger than the second lobe.

* * * * *